United States Patent [19]

Volk

[11] Patent Number: 4,772,133

[45] Date of Patent: Sep. 20, 1988

[54] CARRYING HANDLE FOR BAGGED FOOD ITEMS

[76] Inventor: Henry J. Volk, 3512 Hawkeye, Turlock, Calif. 95380

[21] Appl. No.: 76,799

[22] Filed: Jul. 23, 1987

[51] Int. Cl.[4] ..... B65D 33/06

[52] U.S. Cl. ..... 383/6; 383/13; 383/25

[58] Field of Search ..... 383/6, 13, 24, 25, 29, 383/30; 229/DIG. 6

[56] References Cited

U.S. PATENT DOCUMENTS

| | | | |
|---|---|---|---|
| 2,981,990 | 5/1961 | Balderree, Jr. | 383/25 |
| 3,548,906 | 12/1970 | Murphy | 383/25 |
| 4,596,397 | 6/1986 | Conti | 383/13 |

FOREIGN PATENT DOCUMENTS

| | | | |
|---|---|---|---|
| 2949372 | 7/1981 | Fed. Rep. of Germany | 383/25 |
| 362027 | 6/1962 | Switzerland | 383/6 |

*Primary Examiner*—Willis Little

[57] ABSTRACT

A carrying handle is provided for use in conjunction with food items such a whole bodied turkeys which have been shrink wrapped and where the wrapping is secured at one end with a retaining clip. The carrying handle has a clamp which is drawn into position around the shrink wrapping at a point between the retaining clip and the food item. A pair of flexible arms is connected to the clamp and allow the carrying handle to either lie flat against the food item or to be lifted away from the food item. A finger-hold is connected to the arms allowing the user to grab the handle with one or more fingers.

5 Claims, 2 Drawing Sheets

CARRYING HANDLE FOR BAGGED FOOD ITEMS

SUMMARY OF THE INVENTION

This invention relates generally to a carrying handle for wrapped food items. The carrying handle is particularly useful for whole bodied turkeys which have been shrink-wrapped and wherein the shrink wrap is secured at one end with a retaining clip.

At present, these whole bodied turkeys are handled by simply grasping the sides of the carcass and lifting. This is less than satisfactory if the shrink wrap is wet, because the carcass is very heavy and difficult to handle when the shrink wrap becomes damp. Another disadvantage to handling whole bodied wrapped turkeys is if one is dropped on another, the wrappings occasionally become torn, resulting in spoilage of the carcass.

The present invention is a carrying handle which is applied to the wrapped food items such as whole bodied turkeys by drawing the device around the shrink wrapping at a point between the retaining clip and the food item.

A primary object of the invention is to provide a carrying handle for use with wrapped food items wherein the wrapping is secured at one end with the retaining clip such that a shopper may simply attach the carrying handle and easily carry the wrapped food item.

Another object of the invention is to provide a carrying handle for wrapped whole bodied turkeys which may be applied by the processor and which will lie flat against the carcass until grabbed by the user, at which point the handle flexes to allow the user to carry the turkey.

A further object of the invention is to provide a simple and economical carrying handle which may be used to carry a variety of food items which have been wrapped and wherein the wrapping is secured at one end with a retaining clip.

Other objects and advantages of the invention will become apparent from the following description and the drawings.

DETAILED DESCRIPTION OF THE DRAWINGS

Figure 1:
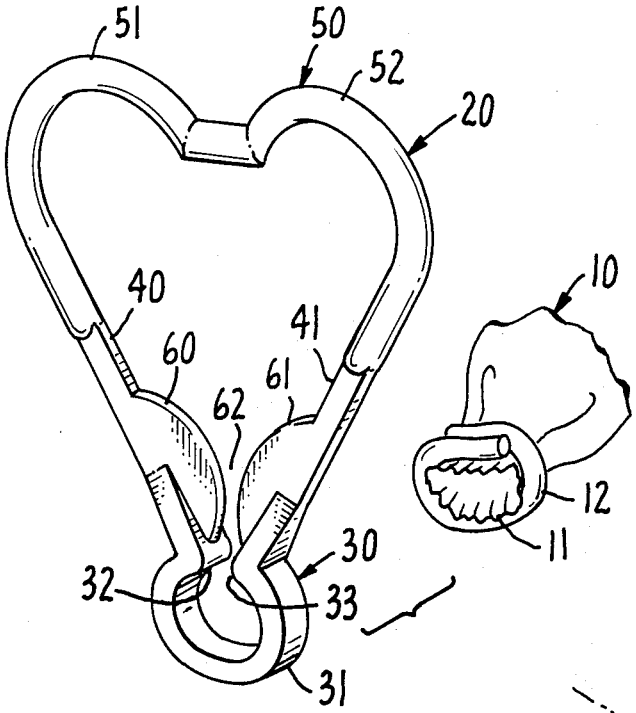
FIG. 1 is a perspective view of a carrying handle according to the present invention.
Figure 2A:
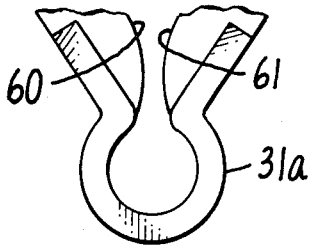
FIG. 2A is an elevational view of a portion of the carrying handle of alternate design.
Figure 4:
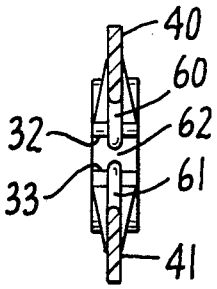
FIG. 4 is a section on the line 4—4 of FIG. 3.

Referring to FIGS. 1–4, a carrying handle indicated generally as 20 is shown for use in carrying food items such as a whole bodied turkey shown generally as 10 which has been wrapped as by shrink wrapping and wherein said wrapping 11 is secured at one end with a retaining clip 12. Clamping means shown generally as 30 comprises a generally elliptically-shaped ring 31 (FIGS. 1 and 2) of between 270°–300°. As shown in FIG. 2A, the clamping ring 31*a* may be circular. Opening 34 is formed between the ends 32 and 33 of clamping ring 31. The opening 34 is used to draw clamping means 30 into the position shown in FIG. 3 wherein the carrying handle is in position to be used to carry the food item, which in this case is a turkey carcass.

A pair of flexible arm means 40 and 41 is connected to clamping means 30. In the embodiment shown in FIGS. 1–4, the carrying handle is molded plastic and is a single piece. Arms 40 and 41 are quite flexible relative to clamping means 30 because of reduced thickness as shown best in FIG. 3. The thickness of arms 40 and 41 is 50% or less than the thickness of clamping ring 31.

Figure 2:
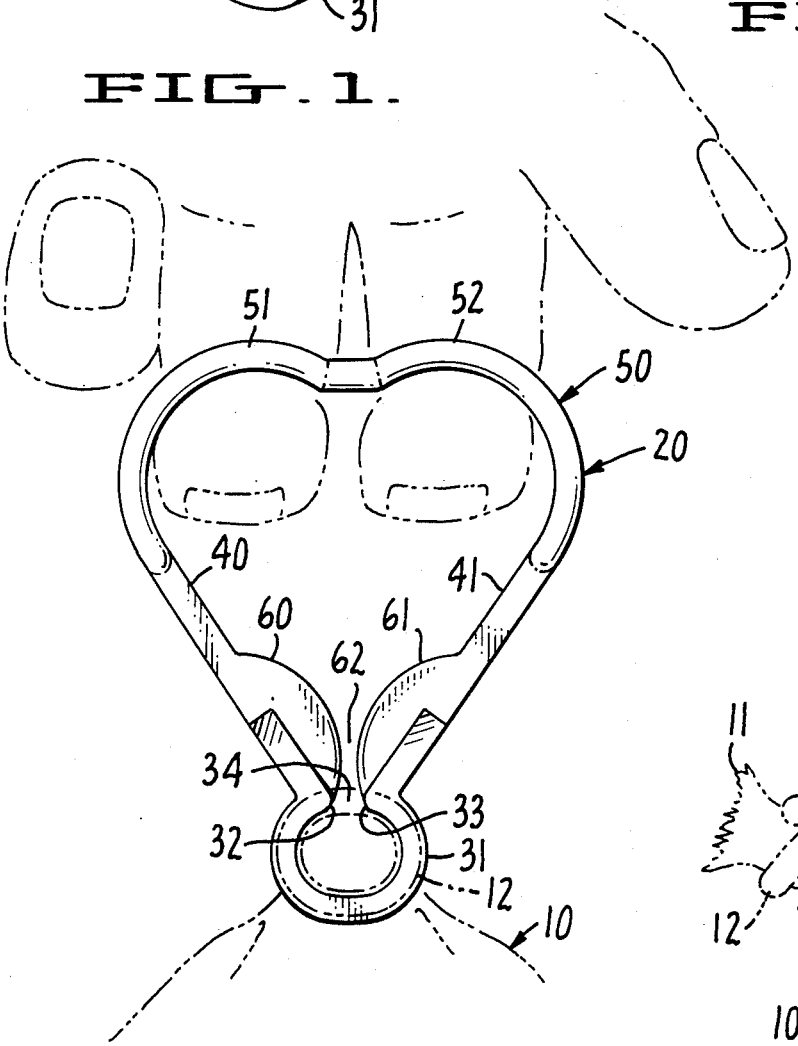
FIG. 2 is an elevational view of the carrying handle of the present invention shown schematically in use.
Figure 3:
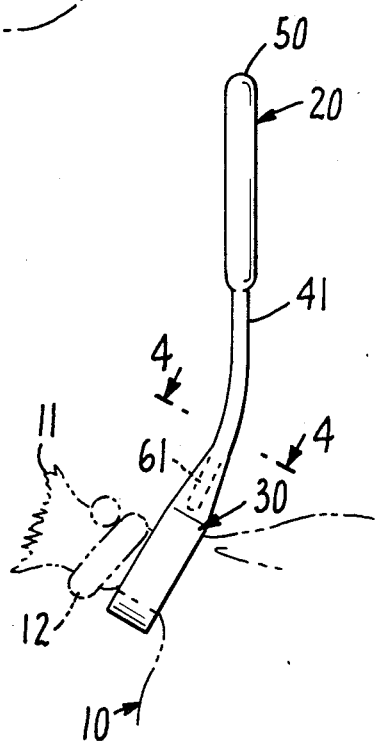
FIG. 3 is a side view of the carrying handle shown in FIG. 2.

Finger-hold means 50 is connected to flexible arms 40 and 41 and, in the embodiment shown in FIGS. 1–4, has a pair of arcuate loops 51 and 52 adapted to receive fingers of the user as shown best in FIG. 2. As shown in FIG. 3, the thickness of finger-hold means 50 is at least 150% the thickness of arms 40 and 41.

A pair of ears 60 and 61 are carried by flexible arms 40 and 41, respectively. Ears 60 and 61 form a restriction 62 therebetween shown best in FIG. 4. The purpose of restriction 62 is to prevent the inadvertent falling off of the carrying handle after it is in place as shown in FIG. 2. The surfaces of ears 60 and 61 diverge in both directions away from restriction 62. This diverging surface on the one hand facilitates the easy insertion of the handle onto wrapping 11 and also prevents the handle from inadvertently falling off the wrapping 11.

Figure 5A:
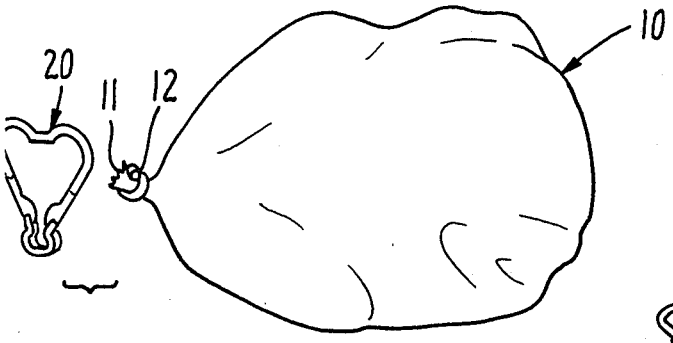
FIGS. 5A–5D are schematic representations of how the carrying handle is applied to a shrink wrapped whole bodied turkey.
Figure 5B:
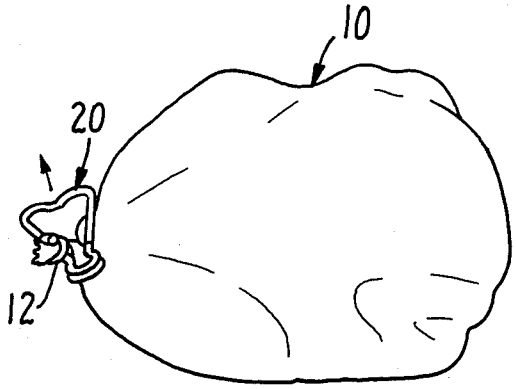
Figure 5C:
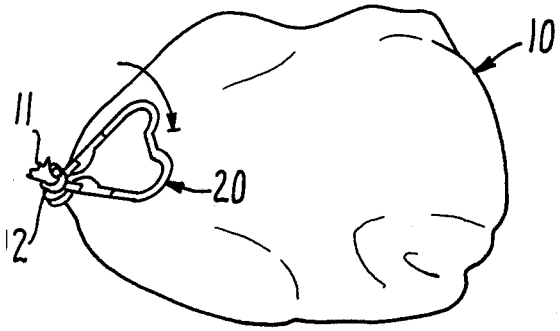
Figure 5D:
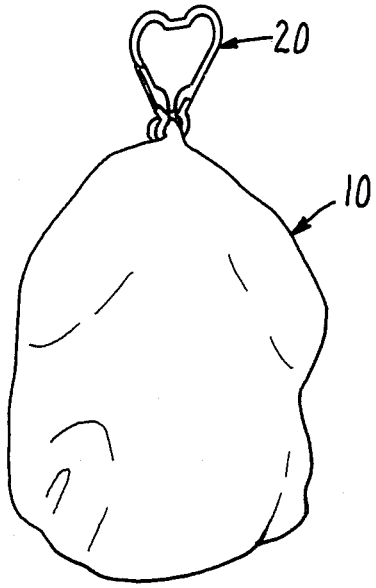

FIGS. 5A–5D show in general the operational characteristics of carrying handle 20. As shown in FIG. 5B, the carrying handle 20 is in position to be applied between retaining clip 12 and the turkey carcass 10 and is drawn in the direction of the arrow, which is the direction of the narrow portion of elliptical ring 12 shown in FIG. 1. The handle is then rotated 90° as shown in FIG. 5C so that the elliptical shape of retaining clip 12 aligns with the elliptical shape of clamping ring 31, forming a locking mechanism. The carrying handle 20 is lying against the carcass 10 in FIG. 5C. FIG. 5D shows the carrying handle 20 in its position in which the user would be carrying the turkey carcass 10. The carrying handle 20 is of such design that it may be installed on turkey carcasses and other poultry carcasses by the processor and shipped to market along with the carcasses.

The carrying handle shown may be used on boneless turkey rolls or roasts, wrapped turkey parts, ducklings and boneless ham rolls or roasts as well.

Figure 6:
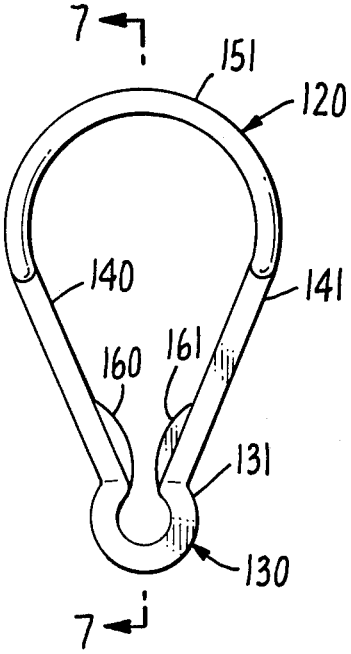
FIG. 6 is a plan view of an alternate embodiment of the invention.
Figure 7:
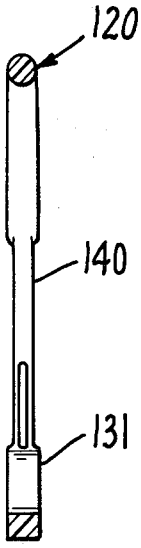
FIG. 7 is a section on the line 7—7 of FIG. 6.

FIGS. 6 and 7 show an alternate embodiment 120, which is similar to the embodiment shown in FIGS. 1–4, except that the finger-hold is designed to accommodate one finger instead of two and the food items with which the carrying handle 120 is used are smaller food items. Clamping means 130 is intended to grip the wrapping between the retaining clip and the food item. Flexible arms 140 and 141 are provided which lie flat against the food item in one position and extend away from the food item in the carrying position. Ears 160 and 161 facilitate the insertion of the device and prevent the inadvertent falling off of the handle from the food item.

Figure 8:
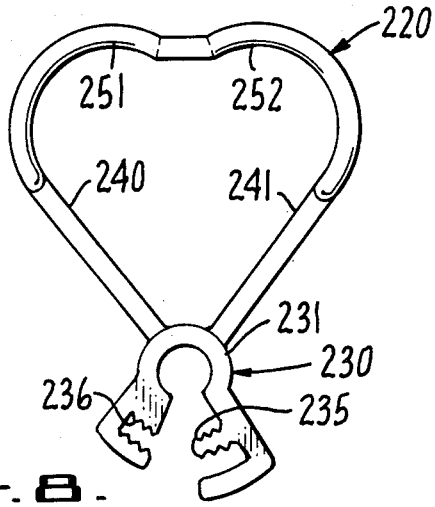
FIG. 8 is a plan view of yet another embodiment of the invention.

FIG. 8 shows a third embodiment of the invention 220 which includes two finger-holds 251 and 252, flexible arms 240 and 241 and a modified clamping means 230. Clamping means 230 includes a resilient snap connector including a toothed male end 235 and a toothed receptacle 236 which are adapted to be squeezed closed after the circular portion 231 is placed in position between retaining clip 12 and food item 10.

What is claimed is:

1. A carrying handle for use in conjunction with food items which have been wrapped and wherein said wrapping is secured at one end with a retaining clip, comprising:

clamping means adapted to be placed into position around said wrapping at a point between said retaining clip and said food item, finger-hold means connected to said clamping means whereby the user inserts one or more fingers into said finger-hold means to carry said food item, and a pair of flexible arm means located between said clamping means and said finger-hold means whereby said carrying handle will either lie against said food item or may be pulled away from said food item as said food item is carried.

2. The device of claim 1 further comprising a pair of ears carried by said flexible arm means, said ears forming a restriction therebetween and having surfaces which diverge in both directions away from said restriction, thereby preventing said handle from inadvertently falling off and also to facilitate insertion of said handle onto said wrapping.

3. The device of claim 1 wherein said clamping means has a resilient, snap connector including a toothed male end and a toothed receptacle, adapted to be squeezed closed after said handle is placed in position around said wrapping.

4. A carrying handle for use in conjunction with meat items which have been shrink-wrapped and wherein the shrink wrapping is secured at one end with a retaining clip, comprising:

clamping means adapted to be drawn into position around said shrink wrapping at a point between said retaining clip and said meat item, a pair of flexible arm means connected to said clamping means, said flexible arm means capable of bending from a first position wherein said arm means lie against the surface of the shrink-wrapped meat item to a second position wherein said arm means extend away from the surface of the shrink-wrapped meat item to allow carrying of said meat item, and finger-hold means connected to said arm means whereby the user inserts one or more fingers into said finger-hold means to carry said meat item.

5. The device of claim 4 wherein said retaining clip is elliptical and wherein said clamping means is elliptical, and wherein said clamping means is drawn around said shrink wrapping in the direction of the narrow portion of said elliptical retaining clip and is then rotated to form a locking means in which the elliptical shapes of said retaining clip and clamping means are in alignment.

* * * * *